US006488599B2

(12) United States Patent
Nye

(10) Patent No.: US 6,488,599 B2
(45) Date of Patent: Dec. 3, 2002

(54) SYSTEM AND METHOD FOR BASKETBALL GOAL HEIGHT ADJUSTMENT

(75) Inventor: S. Curtis Nye, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 09/876,828

(22) Filed: Jun. 6, 2001

(65) Prior Publication Data

US 2002/0004431 A1 Jan. 10, 2002

Related U.S. Application Data

(60) Provisional application No. 60/210,176, filed on Jun. 6, 2000, and provisional application No. 60/263,029, filed on Jan. 19, 2001.

(51) Int. Cl.[7] ..... A63B 63/08

(52) U.S. Cl. ..... 473/483; 483/484

(58) Field of Search ..... 473/483, 484, 473/482, 481, 471; 248/274.1, 295.11, 297.11

(56) References Cited

U.S. PATENT DOCUMENTS

| | | | | |
|---|---|---|---|---|
| 171,746 | A | | 1/1876 | Starr |
| 276,637 | A | | 5/1883 | Slater |
| 466,464 | A | | 1/1892 | Hood et al. |
| 1,130,831 | A | | 3/1915 | Madell |
| 1,320,613 | A | | 11/1919 | Gilcrease |
| 2,228,592 | A | | 1/1941 | Curtis |
| 3,811,151 | A | | 5/1974 | Kuemmerlin |
| 3,955,240 | A | | 5/1976 | Schuh et al. |
| 4,216,844 | A | | 8/1980 | Klafs |
| 4,407,045 | A | | 10/1983 | Boothe |
| 4,566,150 | A | | 1/1986 | Boothe |
| D350,797 | S | | 9/1994 | Curtis |
| 5,375,835 | A | | 12/1994 | Van Nimwegan |
| 5,465,957 | A | * | 11/1995 | Schroeder ..... 473/484 |
| 5,478,068 | A | * | 12/1995 | Schroeder ..... 473/484 |
| 5,695,417 | A | * | 12/1997 | Winter et al. ..... 473/484 |
| 5,720,679 | A | | 2/1998 | Schroeder |
| 5,738,601 | A | * | 4/1998 | Hughes ..... 473/484 |
| 5,836,838 | A | | 11/1998 | Van Nimwegan |
| 5,879,247 | A | * | 3/1999 | Winter et al. ..... 473/484 |
| 5,947,847 | A | | 9/1999 | Van Nimwegan |
| 6,077,177 | A | * | 6/2000 | Winter et al. ..... 473/484 |
| 6,120,396 | A | * | 9/2000 | Van Nimwegen et al. .. 473/484 |
| 6,142,891 | A | * | 11/2000 | Winter et al. ..... 473/484 |
| 6,273,834 | B1 | * | 8/2001 | Winter ..... 473/484 |

* cited by examiner

*Primary Examiner*—Sebastiano Passaniti
*Assistant Examiner*—M. Chambers
(74) *Attorney, Agent, or Firm*—Workman, Nydegger & Seeley

(57) ABSTRACT

The present invention relates to quick-release locking mechanisms for adjustable basketball goal systems and methods for using the same to adjust the height of a basketball goal above a playing surface. An adjustable basketball goal system may include basketball goal connected to a rigid support via a deformable goal support structure. A second arm may be coupled to the rigid support. A first arm may be coupled to the deformable goal support structure and may slidably engage the second arm. According to one embodiment, locking plates may selectively bind the second arm with respect to the first to selectively lock relative motion of the arms to maintain the basketball goal at a desired height. According to an alternative embodiment, an engagement grip maybe attached to the first arm, and may contain multiple locking members configured to pivot to simultaneously engage openings formed in the second arm to prevent movement of a first arm relative to the second arm. According to another alternative, an engagement grip may have only a single locking member configured to slide into one of a plurality of openings disposed along the length of the second arm.

47 Claims, 10 Drawing Sheets

SYSTEM AND METHOD FOR BASKETBALL GOAL HEIGHT ADJUSTMENT

RELATED U.S. APPLICATIONS

This application claims the benefit of U.S. Provisional Application No. 60/210,176 filed Jun. 6, 2000 and entitled SELF-ADJUSTING SPRING-BIASED ADJUSTMENT ASSEMBLY FOR BASKETBALL GOAL SYSTEMS and of U.S. Provisional Application No. 60/263,029 filed Jan. 19, 2001 and entitled SLIDE COLLAR ADJUSTMENT MECHANISM FOR A BASKETBALL GOAL ASSEMBLY, both of which are incorporated herein by reference.

BACKGROUND OF THE INVENTION

1. The Field of the Invention

The present invention is related to apparatus and methods for adjusting the height of a basketball goal and, more particularly, to basketball goal height-adjustment systems in which a biased locking member can be utilized to selectively fix the position of a first arm relative to a second arm, thereby locking the basketball goal at a desired height.

2. Technical Background

Basketball is an increasingly popular sport In the United States and abroad. There are many cities, counties, and other associations that sponsor recreational and instruction leagues where people of all ages can participate in the sport of basketball. Today there are organized leagues for children as young as five and six years old. Accordingly, it is not surprising that more and more people have a basketball goal on their property.

The problem with many basketball goals is that the goal is usually fixed at a certain height above the playing surface with a standard height being about ten (10) feet. Children and younger teens, however, generally don't have the strength or agility to make a basket at a height of ten feet. Moreover, children tend to develop improper shooting skills attempting to throw a basketball toward a goal that is too high. Oftentimes, children or younger teens get frustrated with the sport of basketball and may give up the sport altogether.

Many attempts have been made by those skilled in the art to design basketball goal systems that are adjustable to several different heights. Such adjustment allows persons of all ages and sizes to enjoy the sport of basketball because the basketball goal can be adjusted to suit the height of the player. Some of the prior art basketball goal systems employ a deformable linkage design that connects the backboard to a rigid mount such as a pole. In operation, prior art deformable linkages can be selectively locked at various positions to secure the basketball goal at a predetermined height above a playing surface.

One disadvantage of prior art deformable linkage devices is that the adjustment mechanism is typically positioned within or near the linkage well above the playing surface. Accordingly, whenever a user desires to adjust the height of the basketball goal, the use of a ladder, stool, or the like is required to enable the user to reach the adjustment mechanism and "unlock" the basketball goal. The need to use a ladder, stool, or the like to adjust the height of the basketball goal creates an inherent danger of injury due to falling.

Other prior art adjustable basketball goal systems have adjustment mechanisms that are only accessible through the use of a separate rod or pole, such as a broomstick handle. Often, no such adjustment device is readily available. The user must therefore deal with the inconvenience of finding a suitable implement, or simply choose not to adjust the height of the basketball goal.

Many adjustable basketball goals also are designed such that the entire weight of the basketball goal bears directly on the adjustment system. One disadvantage of these prior art configurations is that it takes more strength and patience to adjust the height of the basketball goal than typical children or younger teens possess. This is unfortunate because it is usually small children or younger teens who have the greatest need to adjust the height of the basketball goal.

Another disadvantage of many prior art adjustable basketball goal systems is that the adjustment mechanism is generally separate and distinct from the securing apparatus. In this regard, both hands of a user are normally needed to simultaneously unlock the system, adjust it, and then lock it again in a predetermined position.

Yet another disadvantage of prior art basketball goal adjustment systems is that many of the securing and adjustment mechanisms require numerous working components and a complex design configuration to adjust and secure the basketball goal system in a predetermined position above a playing surface. Consequently, the cost, difficulty of manufacture, and assembly time are increased.

From the foregoing, it will be appreciated that it would be an advancement in the art to provide an adjustable basketball goal system that can be adjusted without the use of a ladder or a pole. It would be a further advancement to provide such an adjustable basketball goal system that could be adjusted quickly and easily with a single hand of a user. Finally, it would-be another advancement in the art to provide such an adjustable basketball goal system that is simple in design and cost effective to manufacture.

BRIEF SUMMARY OF THE INVENTION

The present invention is directed to quick-release locking mechanisms that facilitate height adjustment for adjustable basketball goal systems. A basketball goal system according to the present invention may include a rigid support that extends in a substantially upward direction. The rigid support may have a goal side and a back side opposite the goal side. A deformable goal support structure may be pivotally attached to the goal side of the rigid support such that the deformable goal support structure is suspended above a playing surface. A basketball goal may be attached to the deformable goal support structure adjacent the goal side of the rigid support. In one embodiment, the goal consists of a rim.

The deformable goal support structure may be configured such deformation of the deformable goal support structure produces a corresponding change in the height of the basketball goal above the playing surface. Each variation in height of the basketball goal may correspond to a different configuration of the deformable goal support structure. In operation, the deformable goal support structure may maintain the rim of the basketball goal in a substantially horizontal orientation during adjustment.

A first arm may be coupled at a first end to the deformable goal support structure and may extend along the back side of the rigid support. In one embodiment, a second arm may be coupled at a first end to the back side of the rigid support. A second end of the second arm may slidably cooperate with the first arm. In one embodiment, the second end of the second arm engages a second end of the first arm in a telescoping manner.

In one embodiment, one or more locking plates may be positioned within an opening formed in the first arm. The locking plates may include openings through which the second arm extends. The openings may be configured to permit the locking plates to be disposed in a non-perpendicular angle with respect to the second arm.

In one embodiment, a biasing member is operably disposed between the locking plates such that the locking plates are biased away from each other into a non-perpendicular position with respect to the second arm. In this configuration, the plates within the first arm bind the second arm to prevent relative motion between the first and second arms, thus securing the basketball goal at a particular height. This design efficiently utilizes the forces acting on the adjustable basketball goal system to lock the system in place without the need of a complex operational design or numerous intricate working components.

An adjustment handle may be movably attached to an outside surface of the first arm to engage one end of each of the respective locking plates. The adjustment handle may be movable between an engaged position wherein the locking plates bind with the second arm and one or more disengaged positions wherein a portion of the adjustment handle forces a set of locking plates into a substantially perpendicular position relative to the second arm. The adjustment handle may be moved upward or downward along the length of the first arm to release the locking plates that bind the first arm to the second arm. Upon release, movement of the adjustment handle may move the first arm relative to the second arm to deform the deformable goal support structure and thereby adjust the height of the basketball goal.

In an alternative embodiment of the present invention, an engagement grip may be attached to a first arm and may selectively engage corresponding openings formed along the length of a second arm to facilitate adjustment of the height of a basketball goal over a playing surface. The engagement grip may have two locking members disposed along opposing sides of the second arm to selectively engage the openings formed along the length of the second arm, there by permitting the second arm to be locked to the first arm. The locking members may be connected to a release member proximate the handle such that the locking members pivot out of engagement with the openings in response to pressure on the release member.

A housing of the engagement grip may have an internal periphery sufficient to contain the locking member(s). The housing may be rigidly attached to a section of the length of the first arm. A biasing member may be positioned to bias one or more of the locking members into engagement with the openings formed along the length of the second arm to prevent movement of the second arm relative to the first arm when the locking members engage the openings. In one embodiment, an adjustment handle may be attached to or formed in the housing such that a user can actuate the locking member(s) while gripping the handle to selectively engage and disengage the openings formed in the second arm.

According to another alternative embodiment of the present invention, the engagement grip may contain a single locking member, which may be selectively slidable to engage or disengage a plurality of openings formed in the second arm. The locking member may take the form of a locking plate, and each of the openings may take the form of a slot. If desired, the second arm may be shaped such that the locking member engages multiple slots simultaneously. For example, the second arm may have ridges or upraised portions, each of which has a plurality of slots formed therein such that the locking plate may be simultaneously inserted into the slots of multiple ridges. The locking plate may also have prongs to restrain lateral motion of the locking plate with respect to the second arm, thereby providing a more stable adjustment mechanism.

The locking plate may be affixed to a release mechanism, which may take the form of a trigger, at least part of which protrudes from the housing of the engagement grip so that a user can actuate the trigger. The trigger and the locking plate may be biased toward the second arm by a biasing mechanism, such as a linear spring, configured to exert pressure between the trigger and the housing. The housing of the engagement grip may be manufactured from a single piece of material, or from multiple pieces that can subsequently be assembled. If desired, the housing may be constructed of a single piece of molded plastic.

A basketball goal system of the present invention, according to any of the above-described embodiments, may also comprise a counterbalance member such as a spring. The counterbalance member may be coupled between an upper or lower arm of the deformable goal support structure and the backboard. In the alternative, the counterbalance member may be disposed parallel to the first and second arms and may be coupled to the first and second arms or to the deformable goal support structure and the rigid support so that the counterbalance member is disposed along the arms. In operation, the counterbalance member may provide force to at least partially counterbalance the weight of the basketball goal.

One method for adjusting the height of the basketball goal above the playing surface, in accordance with the present invention, may include moving the locking member(s) to a disengaged position, deforming the deformable goal support structure while maintaining the locking member(s) in the disengaged position, and moving the locking member(s) to an engaged position to secure the first arm to the second arm. In certain embodiments, all of these steps may be performed in rapid sequence with only a single hand of a user.

Thus, the present invention may provide quick-release locking mechanisms for adjustable basketball goal systems that are cost effective to manufacture and easy to assemble. The present invention may also provide the ability to adjust the height of the basketball goal without the aid of a ladder or pole. In selected embodiments, a basketball goal system may be unlocked, moved to a new height, and locked again using only a single hand of a user. Moreover, these steps may be performed with only a minimal force applied by the user.

These and other advantages of the present invention will become more fully apparent by examination of the following description of the exemplary embodiments and the accompanying drawings.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE INVENTION

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 8, is not intended to limit the scope of the invention, as claimed, but it is merely representative of the various embodiments of the invention. The invention will be best understood by reference to the drawings, wherein like parts are designated by like numerals throughout.

For this application, the unmodified term "connected" generally refers to a part that influences another part without necessarily contacting the influenced part. The unmodified term "coupled" generally refers to parts that are in contact with each other in some manner, either directly or through one or more intervening members such as fasteners, but are not necessarily rigidly affixed. "Attached" generally refers to parts that are rigidly affixed together, unless the parts are "slidably attached" or "pivotally attached," or otherwise movably attached.

Figure 1:
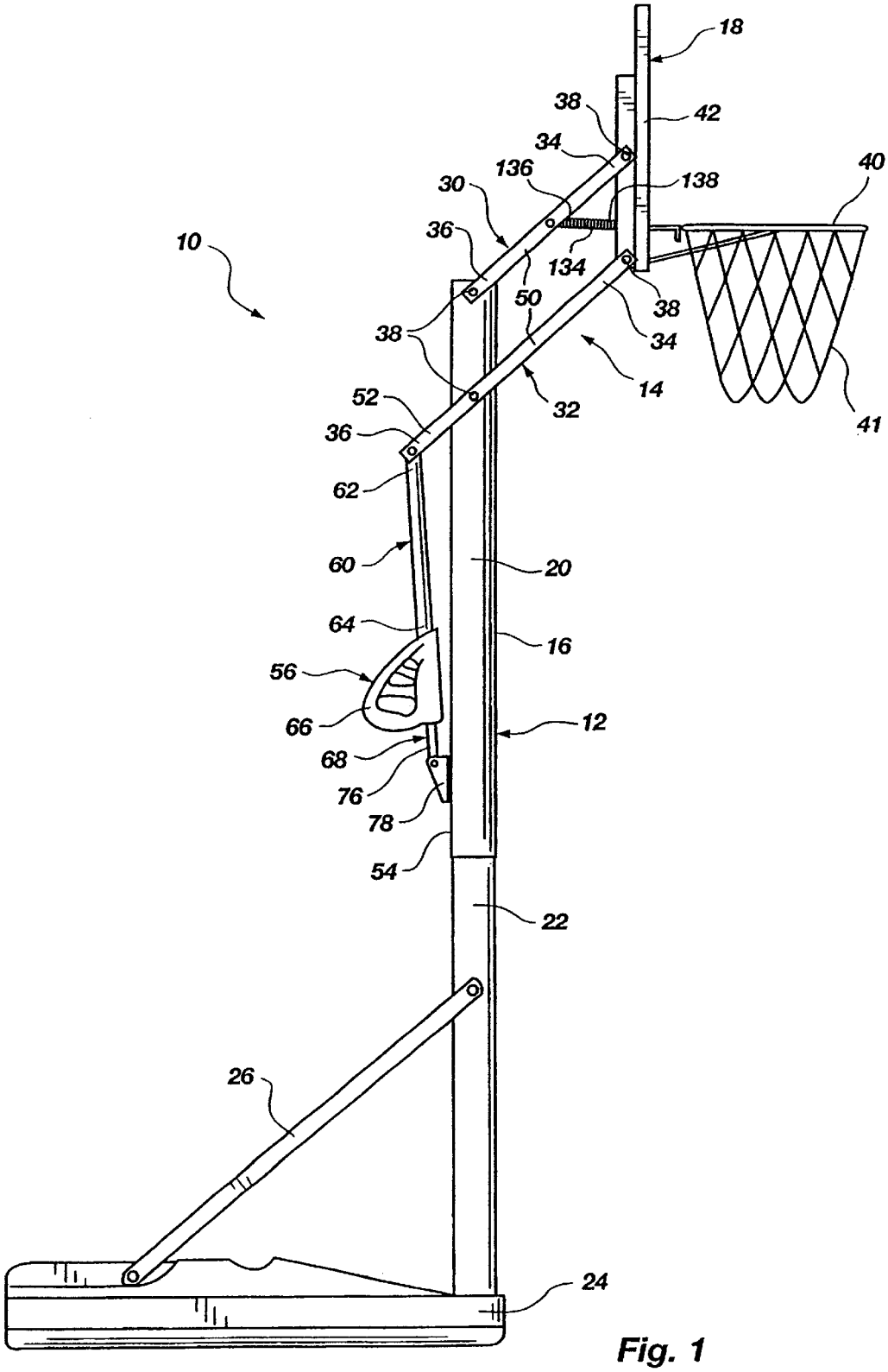
FIG. 1 is a side plan view of one embodiment of an adjustable basketball goal system according to the present invention.

With reference now to FIG. 1, one embodiment of the quick-release locking mechanism for adjustable basketball goal system according to the present invention is generally designated at 10. As shown, the basketball goal system 10 includes a rigid support 12 extending in a substantially upward direction. A deformable goal support structure 14 may be disposed in relation to the rigid support 12 adjacent a goal side 16 of the rigid support 12 above a playing surface. A basketball goal 18 may be attached to the deformable goal support structure 14 opposite the rigid support 12. The deformable goal support structure 14 may be deformable into a plurality of configurations wherein at each configuration the basketball goal 18 may be disposed at a different height above the playing surface.

In one embodiment, the rigid support 12 includes an upper pole section 20, to which the deformable goal support structure 14 may be coupled, and a lower pole section 22 press fit into the upper pole section 20. This configuration makes the system easier and more cost effective to package. The lower pole section 22 may be coupled to a ballast base 24 that, when filled with ballast material, supports and stabilizes the adjustable basketball goal system 10. A pair of rods 26 secure the rigid support 12 to the ballast base 24. As will be appreciated by those of skill in the art, there are a variety of ways readily known in the art to stabilize or secure a rigid support in relation to a base.

The deformable goal support structure 14 of the adjustable basketball goal system 10 comprises an upper support 30 and a lower support 32. The upper and lower supports, 30, 32 each have a first end 34 and a second end 36. In one embodiment, the first end 34 of the upper and lower supports 30, 32, are pivotally attached to the basketball goal 18, which includes a backboard 42, a rim 40 and a net 41 coupled to the rim. The upper and lower supports 30, 32 are each pivotally attached to the rigid support 12 adjacent the second ends 36 of the upper and lower supports 30, 32.

In one embodiment, the upper and lower supports 30, 32 are pivotally attached to the basketball goal 18 and rigid support 12 by bolts 38 positioned through corresponding openings formed within the upper and lower supports 30, 32, the basketball goal 18 and the rigid support 12. As will be appreciated, there are a variety of other ways readily known in the art to pivotally attach a basketball goal to a rigid support 12 as are intended to be herein contemplated.

Structurally, the upper support 30, the lower support 32, the rigid support 12 and the backboard 42 define the deformable goal support structure 14. As best shown in FIG. 1, the deformable goal support structure 14 may be formed having a parallelogrammic configuration. Because the upper support 30 and the lower support 32 are pivotally mounted at each of its opposing ends 34, 36, the parallelogrammic deformable goal support structure 14 can be deformed to adjust the height of the basketball goal 18 while allowing the backboard 42 to remain substantially vertical in disposition and the rim 40 to remain substantially horizontal in disposition.

In one embodiment of the present invention, at least one of the supports 30, 32, includes a tail section 52 that extends a distance outwardly from the back side 54 of the rigid support 12 adjacent the second end 36 of the supports 30, 32. The tail section 52 may be formed integral with the lower support 32. Structurally, the tail section 52 provides a place to link the deformable goal support structure 14 to an adjustment mechanism 56 that may be pivotally mounted adjacent the back side 54 of the rigid support 12 below the deformable goal support structure 14.

Consistent with the foregoing structural configuration, the height of the basketball goal 18 may be adjusted without the aid of a separate adjustment device, ladder, stool, or the like. Further, with the adjustment mechanism 56 located on the back side 54 of the rigid support 12, the adjustment mechanism 56 may be less likely to interfere with basketball play. In one embodiment, the adjustment mechanism 56 comprises a handle 66 operably disposed in cooperation with a second arm 68 and one or more locking plates 70 as discussed in detail herein below.

Still referring to FIG. 1, a first arm 60 includes a first end 62 and a second end 64. The first end 62 of the first arm 60 maybe pivotally attached to the tail section 52 of the lower support 32. The second end 64 of the first arm 60 may be disposed for cooperation with the second arm 68. In one embodiment, the second arm 68 maybe pivotally attached at a first end 76 to the rigid support 12, by a bracket 78. The first end 76 may be flattened (see FIG. 2) to facilitate securement within the bracket 78.

Figure 2:
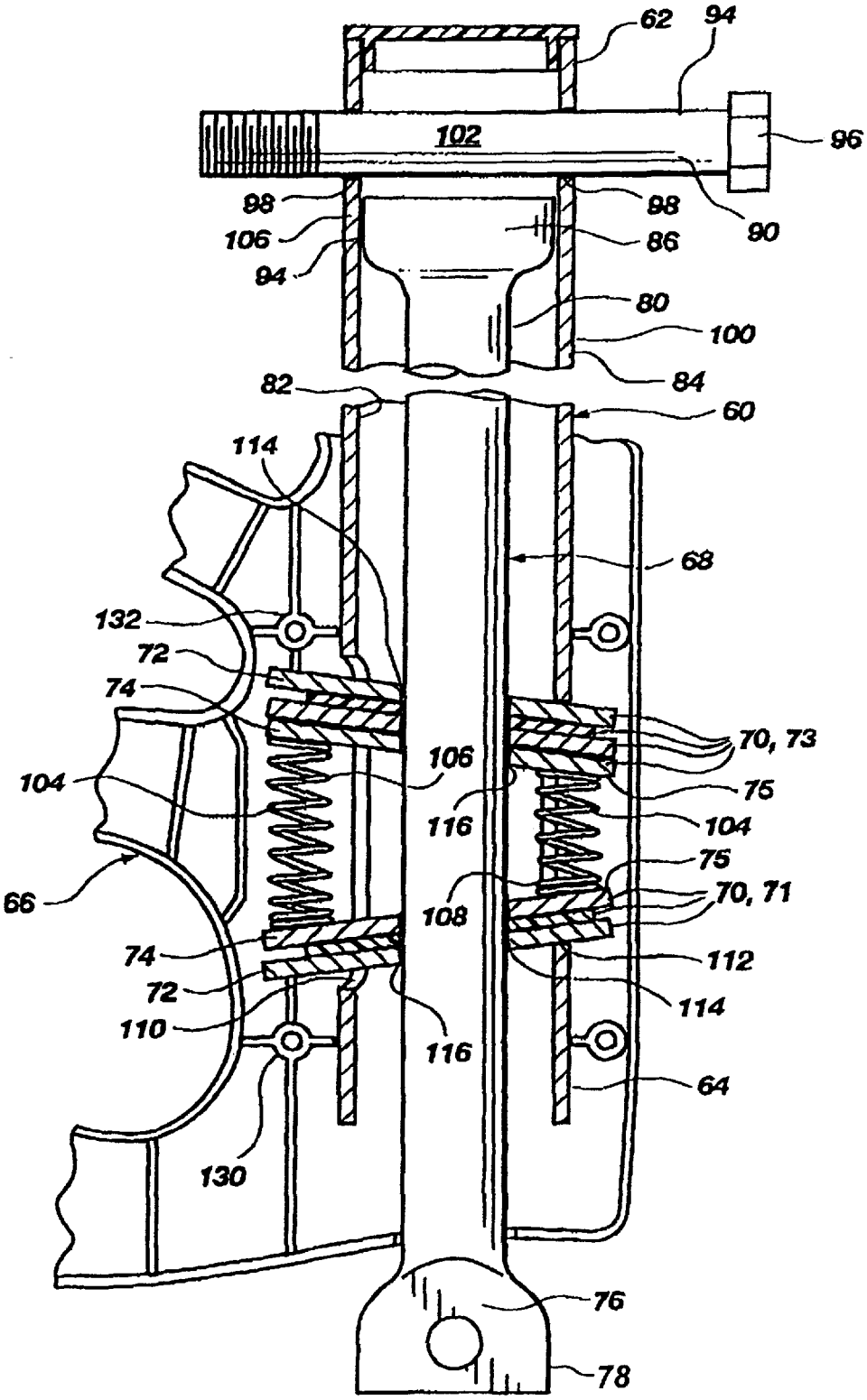
FIG. 2 is a partially cut away, side cross-sectional view of a quick-release locking mechanism of the adjustable basketball goal system of FIG. 1.

With reference now to FIGS. 1 and 2, a second end 80 of the second arm 68 may engage a second end 64 of the first arm 60 in telescopic engagement. Functionally, as the first arm 60 telescopes in an upward direction relative to the second arm 68, the deformable goal support structure 14 will deform and the height of the basketball goal 18 will be lowered in relation to the playing surface. This is because the lower support 32 acts as a lever. As the weight of the basketball goal 18 pulls down at the lower support 32 on the goal side 16 of the rigid support 12, the lower support 32 pulls up on the first arm 60 at the back side 54 of the rigid support 12. Accordingly, with the second arm 68 coupled to the rigid support 12 below the first arm 60, the first arm 60 and second arm 68 are generally disposed in tension, which reduces the chance of buckling at the point of attachment.

In one embodiment of the present invention, the first arm 60 may be substantially hollow with an inner surface 82 and an outer surface 84. The first arm 60 may be substantially cylindrical for case of manufacturing. The second arm 68 may include an expanded portion 86 that flares out at the second end 80 that may be used to center the second arm 68 within the first arm 60. The expanded portion 86 facilitates the smooth interaction between the second arm 68 and the first arm 60.

As will be appreciated by those of skill in the art, the expanded portion 86, in conjunction with the first arm 60 and second arm 68, create a piston-type assembly that assists in safely controlling the speed of adjustment in relation to adjusting the height of the basketball goal 18.

The adjustable basketball goal system 10 of the present invention may include at least one, and optionally two, mechanical stops 94 to limit the telescopic movement of the first arm 60 relative to the second arm 68. A connecting bolt 96, which secures the first arm 60 to the tail section 52 of the deformable goal support structure 14, generally serves to limit movement of the first arm 60 in the downward direction. The connecting bolt 96 maybe positioned through openings 98 formed in opposite sides 100 of the first arm 60 adjacent the first end 62 of the first arm 60. A middle portion 102 of the bolt 96 may be centered within the first arm 60 and thus may be axially aligned with the second arm 68. Accordingly, as the first arm 60 may be lowered relative to the second arm 68, the second end 80 of the second arm 68 will selectively engage the middle portion 102 of the connecting bolt 96 thereby restricting further movement of the first arm 60 in the downward direction.

The expanded portion 86 at the second end 80 of the second arm 68 serves to limit the movement of the first arm 60 in the upward direction. As the first arm 60 moves upward relative to the disposition of the second arm 68, the locking plates 70 positioned within the first arm 60 will generally engage this expanded portion 86 and prevent further movement of the first arm 60 in the upward direction. As will be appreciated by those of skill in the art, the telescopic movement of the first arm 60 relative to the second arm 68 can be limited in a variety of other suitable ways known in the art. For example, the first arm 60 and second arm 68 engage the inner surface 82 of the first arm 60 as the first arm 60 is maneuvered downward over the second arm 68. Any number of pins or tabs attached to or protruding from the inner surface 82 of the first arm 60 or the second arm 68 may also be used as structural stops for limiting movement.

In one embodiment, a first opening 110 may be configured within one side 100 of the first arm 60. A second opening 112 may be configured within an opposing side 100 of the first arm 60. The width of the openings 110, 112 in one embodiment are substantially the same as the width of the locking plates 70 such that when the locking plates 70 are positioned within the openings 110, 112, the locking plates 70 are substantially prevented from lateral or rotational movement in relation to the first arm 60. The length of the openings 110, 112 may be configured to allow the locking plates 70 to be angled away from each other and into binding engagement with the second arm 68.

The locking plates 70 may be formed as flat rectangular pieces, each of which has a substantially uniform thickness. In one embodiment of the present invention, the locking plates 70 are each configured with an opening 114 through which the second arm 68 may be positioned. These openings 114 are larger than the diameter of the second arm 68. This structural configuration allows the locking plates 70 to be positioned in a non-perpendicular angle relative to the second arm 68 while the second arm 68 may be positioned within the openings 114. Accordingly, when the locking plates 70 are biased in a non-perpendicular angle relative to the second arm 68, the locking plates 70 secured within the first arm 60 will bind with the second arm 68, thus preventing the second arm 68 from moving relative to the first arm 60.

As will further be appreciated, a variety of other locking plate 70 and second arm 68 configurations are possible to accomplish this binding effect. For example, the locking plate or plates 70 could be elliptical or have a varying thickness. The locking plate openings 114 could also have varying configurations depending on the configuration of the second arm 68. Of importance is that the opening 114 in locking, plates 70 be configured frictionally such that an edge of the locking plates opening 114 can engage the second arm 68 to cause binding, and also allow for clearance of the second arm 68 through the locking plates 70 when repositioned.

Figure 3:
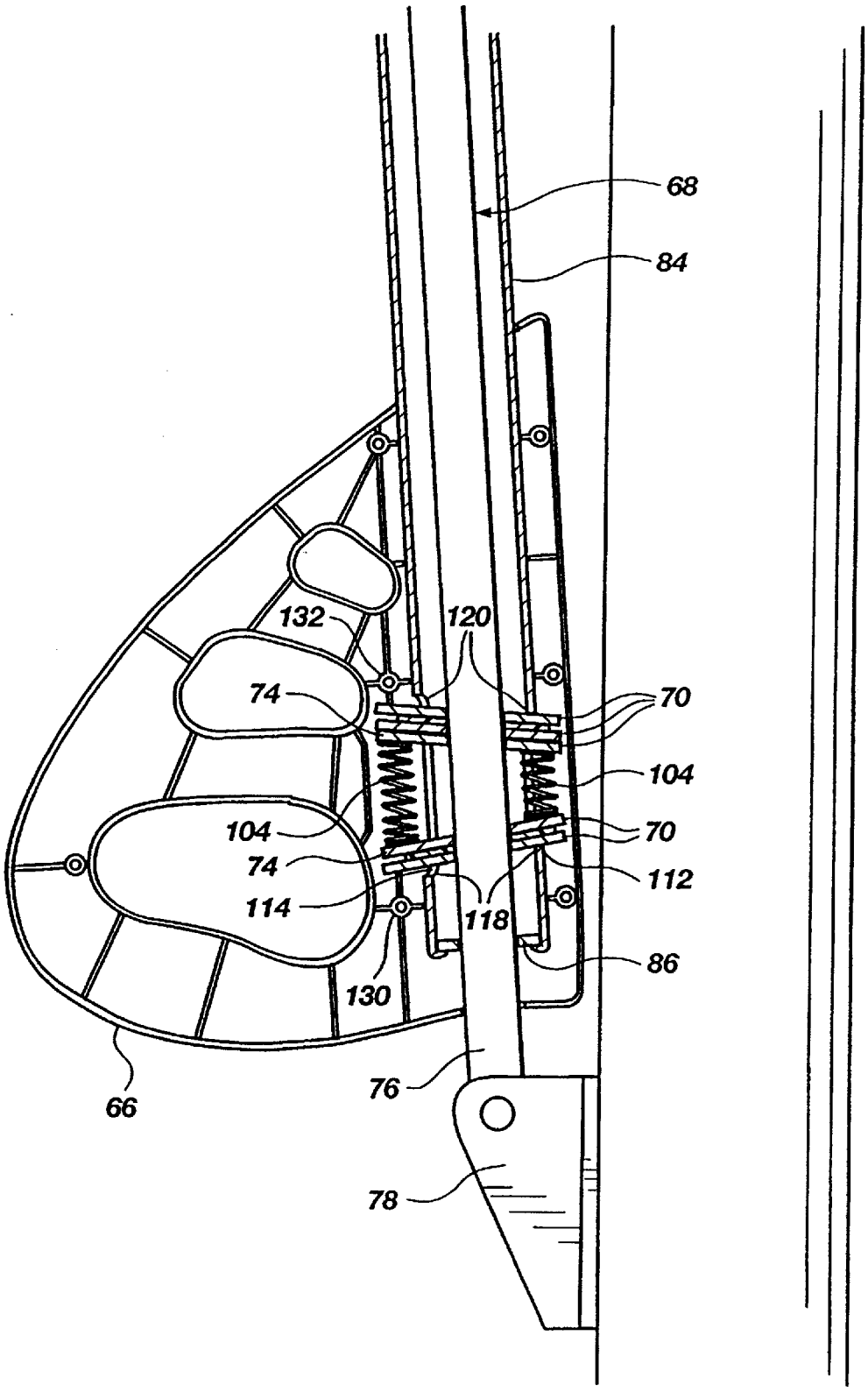
FIG. 3 is a side cross-sectional view of the adjustable basketball goal system of FIG. 1 with an adjustment handle in an engaged position.

In one embodiment of the present invention, a set of three lower locking plates 71 are generally positioned adjacent a bottom end 118 of each opening 110, 112 formed in the first arm 60 and a set of four upper locking plates 73 are positioned adjacent a top end 120 of each opening 110, 112, as shown in FIG. 3. It will be appreciated by those of skill in the art that the locking plates 70 adjacent the bottom end of the openings 110, 112 restrict the movement of the first arm 60 in the upward direction, the direction in the which the first arm 60 may be urged under the force of gravity acting on the basketball goal 18.

The locking plates 70 maybe biased into a non-perpendicular "binding" angle relative to the second arm 68 by a biasing member 104. In one embodiment, the biasing member 104 comprises a first biasing member 106 and second biasing member 108. The first and second biasing members 106, 108 comprises coil springs.

The first biasing member 106 may be positioned between respective first ends 72 of an innermost pair of locking plates 74. The first biasing member 106 angles the locking plates 70 away from each other and into a non-perpendicular angle or "binding position" relative to the second arm 68. Correspondingly, the upper set of locking plates 73 will tend to bind with the second arm 68 as the first arm 60 is moved in the a substantially downward direction and the lower set of locking plates 71 will tend to bind with the second arm 68 as the first arm 60 is moved in a substantially upward direction. In other words, the upper set of locking plates 73 maybe angled to prevent compression of the first arm 60 relative to the second arm 68 (i.e., "compression plates") and the upper set of locking plates 73 may be angled to prevent tension between the first arm 60 and the second arm 68 (i.e., "tension plates").

The second biasing member 108 may be positioned between respective second ends 75 of an innermost pair of locking plates 74. The second biasing member 108 generally provides a force against which the plates 70 may pivot and helps maintain the innermost pair of locking plates 74 in a separated state, thus facilitating the pivotal movement of the locking plates 70.

It will be appreciated by those of skill in the art that a variety of biasing members 104 may used in a variety of configurations to urge the locking plates 70 into non-perpendicular angles relative to the second arm 68 thereby permitting the second arm 68 to bind with the locking plates 70. One such alternative embodiment includes pliable metal disposed between the locking plates 70. In this configuration, the locking plates 70 and the pliable metal could be one unitary piece. In another configuration, tension springs may be used.

Figure 4:
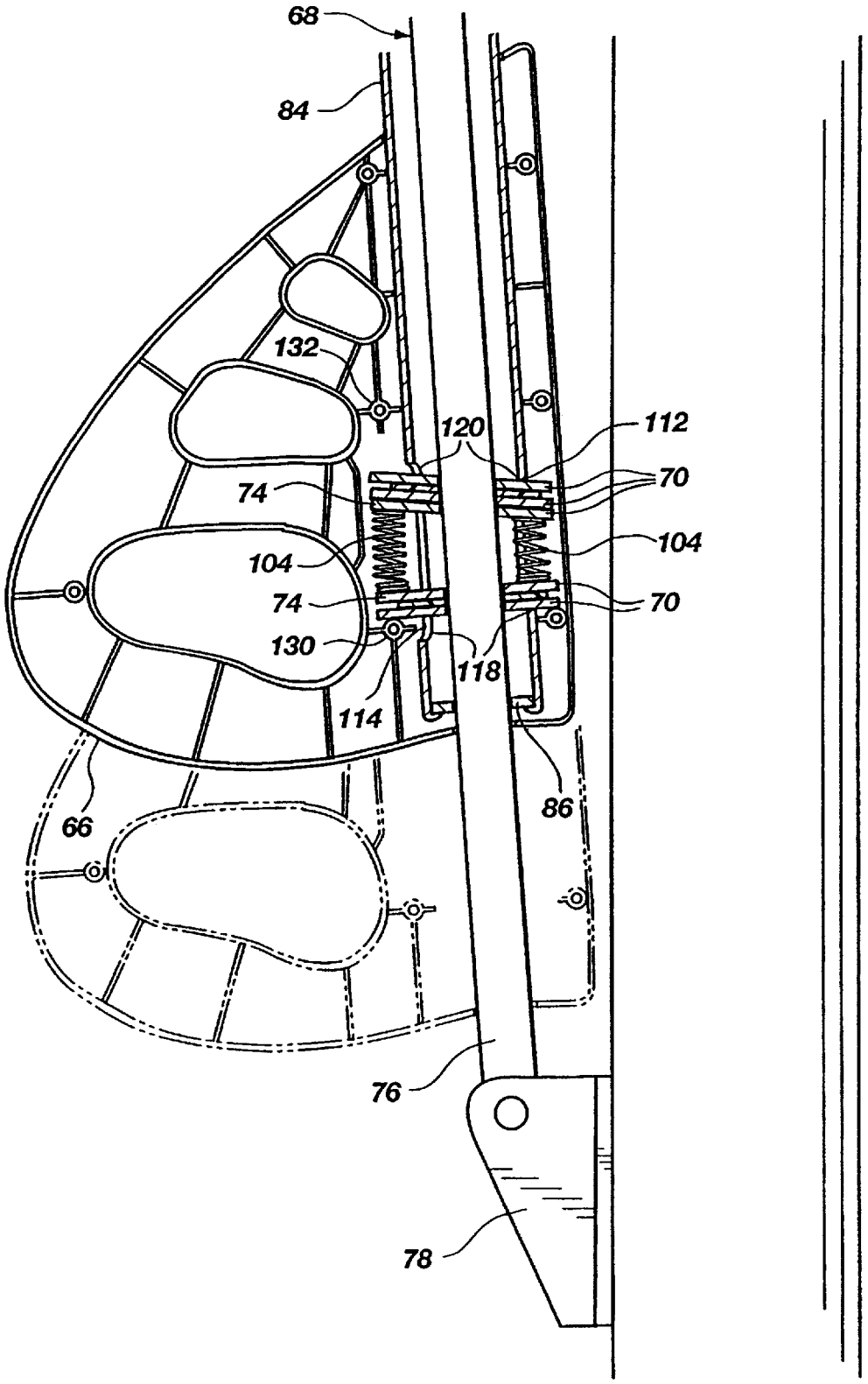
FIG. 4 is a side cross-sectional view of the adjustable basketball goal system of FIG. 1 with the adjustment handle in a disengaged position.

With reference now to FIGS. 2, 3 and 4, the adjustment handle 66 may be movably mounted to the outer surface 84 of the first arm 60. The interior of the adjustment handle 66 may be configured for engagement with the locking plates 70. In one embodiment of the present invention, the adjustment handle 66 has a lower abutment portion 130 and an upper abutment portion 132.

The adjustment handle 66 may be selectively movable between an engaged position, an upward disengaged position, and a downward disengaged position. In the engaged position, a first end 72 of each set of locking plates 70 are angled away from each other, securing the second arm 68 relative to the first arm 60. When the adjustment handle 66 is moved into the upward disengaged position, the lower abutment portion 130 of the adjustment handle 66 forces the tension locking plates 73 into a substantially perpendicular angle relative to the second arm 68. This allows the adjustment handle 66 and first arm 60 to move relatively upwardly in relation to the second arm 68. In the downward disengaged position, the upper abutment portion 132 of the handle 66 forces the compression locking plates 71 into a substantially perpendicular angle relative to the second arm 68. This allows the adjustment handle 66 and first arm 60 to move relatively downward in relation to the second arm 68, thereby compressing the second arm 68 and first arm 60 in relation therebetween.

In certain embodiments, the basketball goal system 10 of FIGS. 1 through 4 may be adjusted by using a single hand of a user. By sliding the adjustment handle 66 substantially upward along the outer surface 84 of the first arm 60, the adjustment handle 66 releases the tension locking plates 70 acting against the second arm 68. At this instance, the first arm 60 may be free to move upward relative to the second arm 68, and continual upward motion adjusts the basketball goal 10 to a lower height above the playing surface. Likewise, by sliding the handle 60 downward along the outer surface 84 of the first arm 60, the handle 66 releases the releases compression locking plates. At this instance, the first arm 60 may be free to move downward relative to the second arm 68, and continual downward motion adjusts the basketball goal 18 to a greater height above the playing surface.

As will be appreciated by those of skill in the art, the adjustment handle 66 can be configured in a variety of ways sufficient to accommodate the release of the binding effect of the locking plates 70 on the second arm 68. For example, one such embodiment involves securing a cross-member to the locking plates 70. The cross-member could extend outwardly through the openings formed in the adjustment handle 66 such that as the handle 66 is engaged, the openings in the handle 66 would engage the cross-member that would in turn move the locking plate 70 into a substantially perpendicular position relative to the second arm 68. This would obviate the need for abutment portions 130, 132.

As best shown in FIG. 1, the adjustable basketball goal system 10 of the present invention may be counterbalanced with counterbalance member 134. In one embodiment, the counterbalance member 134 may be disposed in relation to the deformable goal support structure 14 to provide a force that substantially counterbalances the gravitational force acting on the adjustable basketball goal system 10 due to the inherent weight of the basketball goal 18. The counterbalance member 134 may comprises a coil spring of sufficient rigidity and stiffness to resist the weight of the basketball goal 18. The spring 134 maybe coupled at one end 136 to the upper support 30 of the deformable goal support structure 14 and at a second end 138 to the a frame 140 to which the backboard 42 may be secured, In operation, the counterbalance member 134 allows for adjustment of the height of the basketball goal 18 above the playing surface with minimal effort on the part of the user.

As will be appreciated, there are several ways to counterbalance an adjustable basketball goal system 10. One such way is to place a spring within the first arm 60. One end of the extension spring could be coupled to a connecting bolt pivotally attached to the tail section 52 of one of the supports 30, 32 of the deformable goal support structure 14. The other end could be coupled to the rigid support 12 through a slot formed in the first arm 60. A piston assembly could also be used to counterbalance the adjustable basketball goal system 10.

With reference now to FIGS. 3 and 4, the basketball goal 18 may be adjusted by releasably engaging the adjustment handle 66. In accordance with one such method, the user moves the adjustment handle 66 with a first hand to facilitate one of the abutment portions 130, 132 to engage and reposition the locking plates 70 into a non-binding position relative to the second arm 68. By continuing to move the adjustment handle 66, with the same hand in the same direction, the first arm 60 moves and deforms the deformable goal support structure 14 to one of an infinite plurality of deformations. The user then disengages the adjustment handle 66 to dispose the basketball goal 18 in the desired position above the playing surface.

Figure 5:
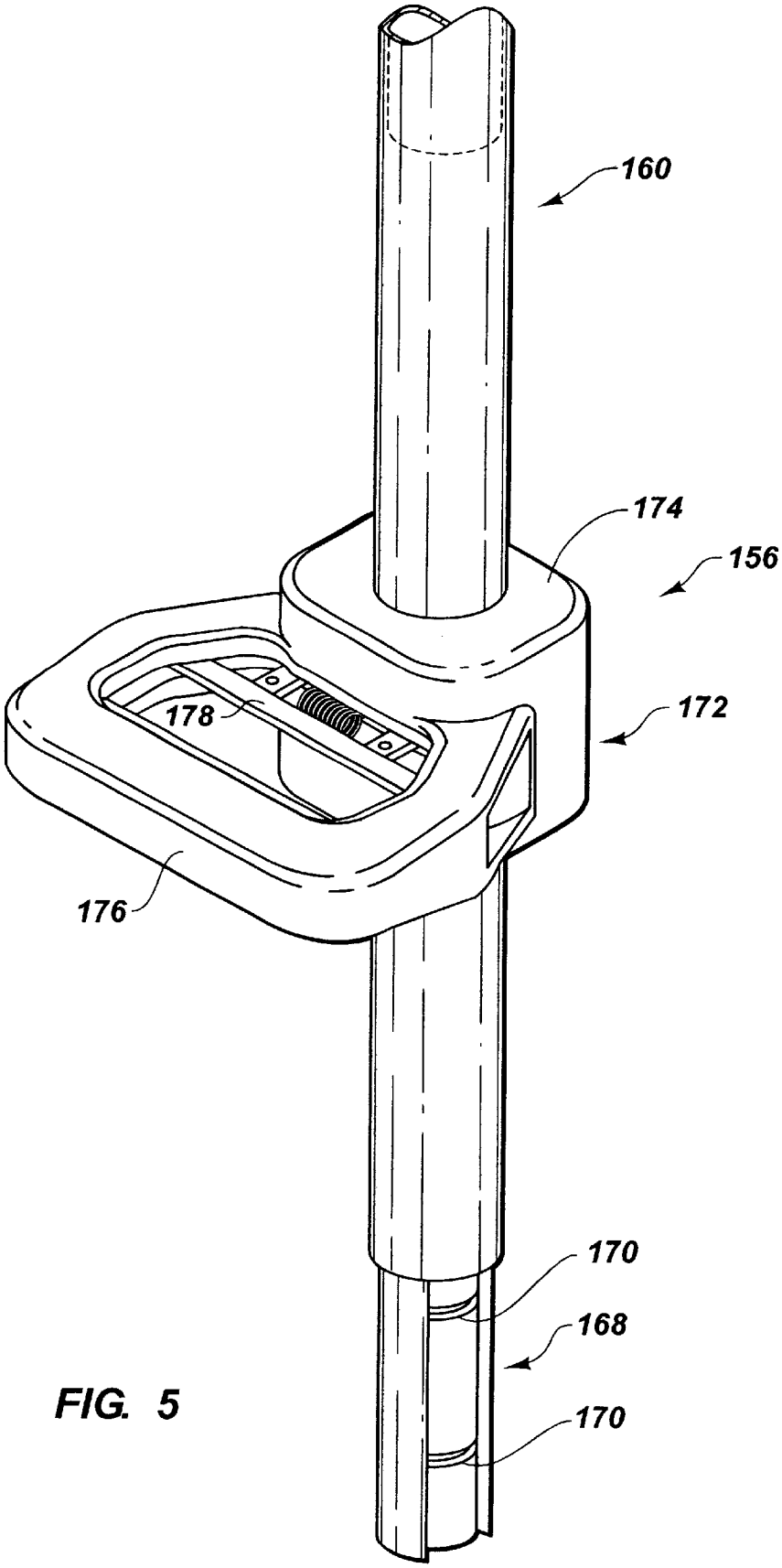
FIG. 5 is a perspective view of an alternative embodiment of a quick-release locking mechanism suitable for an adjustable basketball goal system similar to that of FIG. 1.

Referring now to FIG. 5, an alternate embodiment of an adjustment mechanism 156 according to the invention is depicted; the adjustment mechanism 156 may be utilized in conjunction with the basketball goal system 10 of FIG. 1 in place of the adjustment mechanism 56. Like the adjustment mechanism 56, the adjustment mechanism 156 may be utilized to rapidly disengage a first arm 160 from a second arm 168, so that the first and second arms 160, 168 can slide with respect to each other to permit adjustment of the height of the basketball goal 18. The first and second arms 160, 168 may be coupled to the deformable goal support structure 14 and the rigid support 12 in much the same fashion as the first and second arms 60, 68 depicted in FIG. 1.

In one embodiment, the first arm 160 and the second arm 168 are substantially hollow. The first arm 160 and the second arm 168 may also be substantially cylindrical for ease of manufacturing; however, it will be appreciated that other geometrical shapes or configurations are possible. The sizes of the first arm 160 and the second arm 168 may be selected such that the outer diameter of the second arm 168 is slightly smaller that the inner diameter of the first arm 160. The first arm 160 and the second arm 168 may be sized to interact smoothly with one another in telescoping fashion.

The second arm 168 may have a plurality of openings 170 arrayed along the length of the second arm 168. Each of the openings 170 may be a through-bore with an internal periphery. Alternatively, each of the openings 170 may also be formed as a notch in or on the outer surface of the second arm 154. As another alternative, the openings 170 may include other structures capable of restraining relative motion between the first and second arms 160, 168 when used in combination with some type of locking member. As shown in FIG. 5, each of the openings 170 may be elongated to form slots 170, each of which is disposed around the circumference of the second arm 168.

The slots 170 may be separated from each other by a consistent interval, or by an interval that changes along the length of the second arm 168 to ensure that the interval consistently corresponds to a uniform change in height of the basketball goal 18 between each pair of adjacent slots 170. The adjustment mechanism 156 may have an engagement grip 172 attached to the first arm 160; the engagement grip 172 may be configured such that a user can easily unlock the first and second arms 160, 168 through the use of the engagement grip 172.

As with the previous embodiment, the first arm 160 may have a substantially tubular shape telescopically enclosing the second arm 168. The first arm 160 may be short enough to leave some of the slots 170 exposed. In the alternative, the first arm 160 may be made long enough to cover all of the slots 170 in every relative position of the first and second arms 160, 168 to ensure that no body part of a user can be pinched through insertion into one of the slots 170 and subsequent relative motion of the first and second arms 160, 168. As another alternative, a protective boot constructed of collapsible plastic, rubber, or a similar flexible material may be used to cover the slots 170 to avoid pinching.

The engagement grip 172 may have a housing 174 configured to enclose the components of the engagement grip 172 and further prevent pinching. The housing 174 may have a hollow shape, and may be formed of any material including metals, polymers, elastomers, ceramics, and composites. In one embodiment, the housing 174 is formed from molded plastic. A handle 176 may be attached to the housing 174 through the use of any known attachment mechanism or may be formed in the housing 174 as shown in FIG. 5.

A release member 178 may be disposed within the housing 174. More specifically, the release member 178 may be positioned in close proximity to the handle 176 so that a user grasping the handle 176 with one hand can exert pressure on the release member 178 with the same hand. The release member 178 may, for example, take the form of a handle inset 178 with a profile similar to that of the handle 176. The handle inset 178 may be positioned such that a user grasping the handle 176 will pull the handle inset 178 away from the first and second arms 160, 168.

Figure 6:
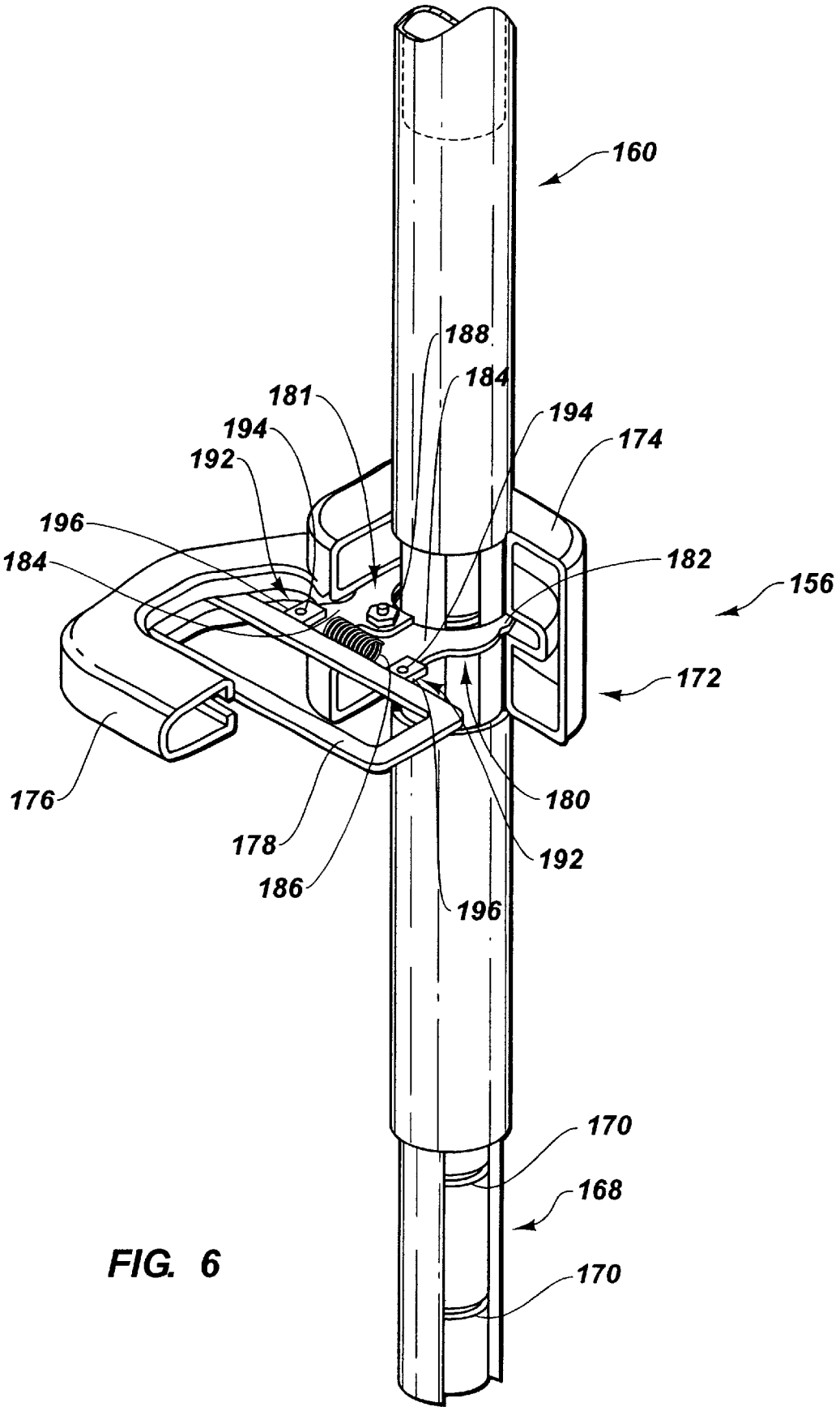
FIG. 6 is a partially cut-away perspective view of the alternate embodiment of FIG. 5 illustrating locking members disengaged from openings formed along the length of a second arm.

Referring to FIG. 6, a cutaway view of the engagement grip 172 of FIG. 5 is shown. The engagement grip 172 may contain a number of components that permit a user to selectively lock the first and second arms 160, 168 with respect to each other by actuating the handle inset 178. More specifically, the handle inset 178 may be coupled to a first locking member 180 configured to selectively engage the slots 170. "Engagement" refers to interaction that produces a barrier to relative motion. The first locking member 180 depicted in FIG. 6 engages one of the slots 170 through the insertion of a portion of the first locking member 180 into the slot so that motion of the first locking member 180 along the second arm 168 is limited by interference of the locking member 180 with the slot 170 in which the first locking member 180 is engaged.

The first locking members 180 may have a wide variety of configurations. For example, the first locking member 180 may take the form of a pin, wedge, plate, or any other shape that can be at least partially inserted into an opening. In order to mate with the slots 170 of FIGS. 5 and 6, the first locking member 180 may take the form of a first locking plate 180 with a thin, substantially planar configuration.

The engagement grip 172 may also have a second locking plate 181 configured to engage a second set of slots (not shown) arrayed along the opposite side of the second arm 168 from the slots 170. Each of the slots 170 may thus have a corresponding slot positioned opposite to it. The second locking plate 181 may thus operate in tandem with the first locking plate 180 to engage a slot of the second set of slots simultaneously with engagement of the first locking plate 180 with one of the slots 170.

The first and second locking plates 180, 181 may each have an engagement end 182 and a biased end 184. The engagement end 182 of each of the locking plates 180, 181 may be the portion that is inserted into one of the slots 170 or into one of the second set of slots. The biased ends 184 may be connected to a biasing member 186 that presses the biased ends 184 apart. The biasing member 186 may take a wide variety of forms including linear springs, torsional springs, leaf springs, gas springs, and the like. In FIG. 6, the biasing member 186 takes the form of a linear spring 186.

The first and second locking plates 180,181 may each be pivotally attached to the housing 174 through the use of a pivot 188. The pivot 188 may take the form of a fastener such as a screw, bolt, rivet, shaft/cotter pin combination, or the like inserted through aligned holes in the locking plates 180, 181 and into a suitable receptacle (not shown) in the housing 174. In the alternative, the first and second locking plates 180, 181 may be coupled together through some other mechanism, such as a linkage including a cam system, sliding attachment, and/or pivotal attachment, a gear system, a belt system, or the like. The first and second locking plates 180, 181 need not necessarily pivot, but may slide or move with some combination of relative translation and rotation. Simple pivotal motion is used for the exemplary embodiment of FIGS. 5 and 6.

Preferably, the pivot 188 is positioned between the engagement end 182 and the biased end 184 of each of the locking plates 180, 181, so that the pivot 188 acts as a fulcrum for lever action. More specifically, the pressure exerted by the linear spring 186 may press the biased ends 184 apart, thereby pushing the engagement ends 182 toward each other and toward the second arm 168.

Consequently, in the absence of any other force acting on the locking plates 180, 181, the engagement ends 182 of the first and second locking plates 180, 181 are automatically inserted into the slot 170 and the corresponding slot of the second set of slots, respectively, if the engagement ends 182 are aligned with those slots. If the engagement ends 182 are not aligned with slots, the engagement ends 182 may press inward against the second arm 168 so that the engagement ends 182 slide into place as soon as they are aligned with one of the slots 170 and one of the second set of slots.

Since the engagement grip 172 may be attached to the first arm 160 and the locking members 180, 181 may be contained within the grip 172 engagement of the locking members 180, 181 with one of the slots 170 and one of the second set of slots serves to substantially prevent movement of the second arm 168 relative to the first arm 160. Thus, in the engaged position, the locking members 180, 181 may serve to selectively secure the first arm 160 and second arm 168 with respect to one another, and therefore maintain the basketball goal 18 at a desired height above the playing surface.

The handle inset 178 maybe pivotally attached to the locking plates 180, 181 such that when the handle inset 178 is drawn away from the first and second arms 160, 168, the biased ends 184 are drawn toward each other to compress the linear spring 186. The engagement ends 182 are thus drawn apart and out of the slots 170 and the second set of slots.

The pivotal attachment may be carried out through the use of a pair of release member attachments 192, each of which serves to pivotally attach the handle inset 178 with one of the locking plates 180, 181. Each of the release member attachments 192 may include a bolt, screw, rivet, shaft/cotter pin combination, or other fastener that permits relative pivotal motion (no such fastener is shown in FIGS. 5 and 6 for clarity). Such a fastener may be inserted through a hole (not shown) in one of the locking plates 180, 181 and through a corresponding hole 174 in the handle inset 178.

If desired, the holes 194 may be located in tabs 196 or other protrusions extending from the main body of the handle inset 178. The holes in the locking plates 180, 181 and/or the holes 194 in the handle inset 178 may be elongated somewhat to form slots (not perceptible in FIGS. 5 and 6) to accommodate the relative pivotal motion of the first and second locking plates 180, 181.

The engagement grip 172 may easily be converted from an engaged position, in which the first and second arms 160, 168 cannot move relative to each other, to a disengaged position, in which relative translation of the first and second arms 160, 168 can occur to permit adjustment of the height of the basketball goal 18. More specifically, the engagement grip 172 may normally rest in the engaged position due to the force provided by the linear spring 186, which tends to keep the locking plates 180, 181 within one of the slots 170 and one of the second set of slots, respectively.

A user may grasp the handle 176, and simultaneously the handle inset 178, thereby pulling the handle inset 178 outward from the first and second arms 160, 168 to pivot the engagement ends 182 of the locking plates 180, 181 out of engagement with the slots 170 and the second set of slots. When the engagement ends 182 are out of the slots 170 and the second set of slots, the user may move the handle 176 upward or downward to change the configuration of the deformable goal support structure 14, thereby changing the height of the basketball goal 18.

As the first arm 160 moves upward with respect to the second arm 168, the deformable goal support structure 14 will deform and the height of the basketball goal 18 will be lowered. The height of the basketball goal 18 may be lowered because the lower support 32 of the basketball goal structure 30 acts as a lever. As the weight of the basketball goal 18 pulls down at the lower support 32 on the goal side 16 of the rigid support 12, the lower support 32 pulls up on the first arm 160, which may be disposed at the back side of the rigid support 12. Accordingly, with the second arm 168 pivotally attached to the rigid support 12 below the first arm 160, the first arm 160 and the second arm 168 are generally disposed in tension, which reduces the chance that buckling will occur in the first arm 160 and/or the second arm 168.

When the basketball goal 18 has reached the desired height, the user may release the handle inset 178 to permit the engagement ends 182 to pivot toward the second arm 168. If the engagement ends 182 are not aligned with one of the slots 170 or with one of the second set of slots, the engagement ends 182 may simply rest against the second arm 168 between the slots 170 and the second slots. The user may then move the handle 176 upward or downward slightly until the engagement ends 182 automatically slide into place within one of the adjacent slots 170 and one of the adjacent slots of the second set of slots.

Figure 7:
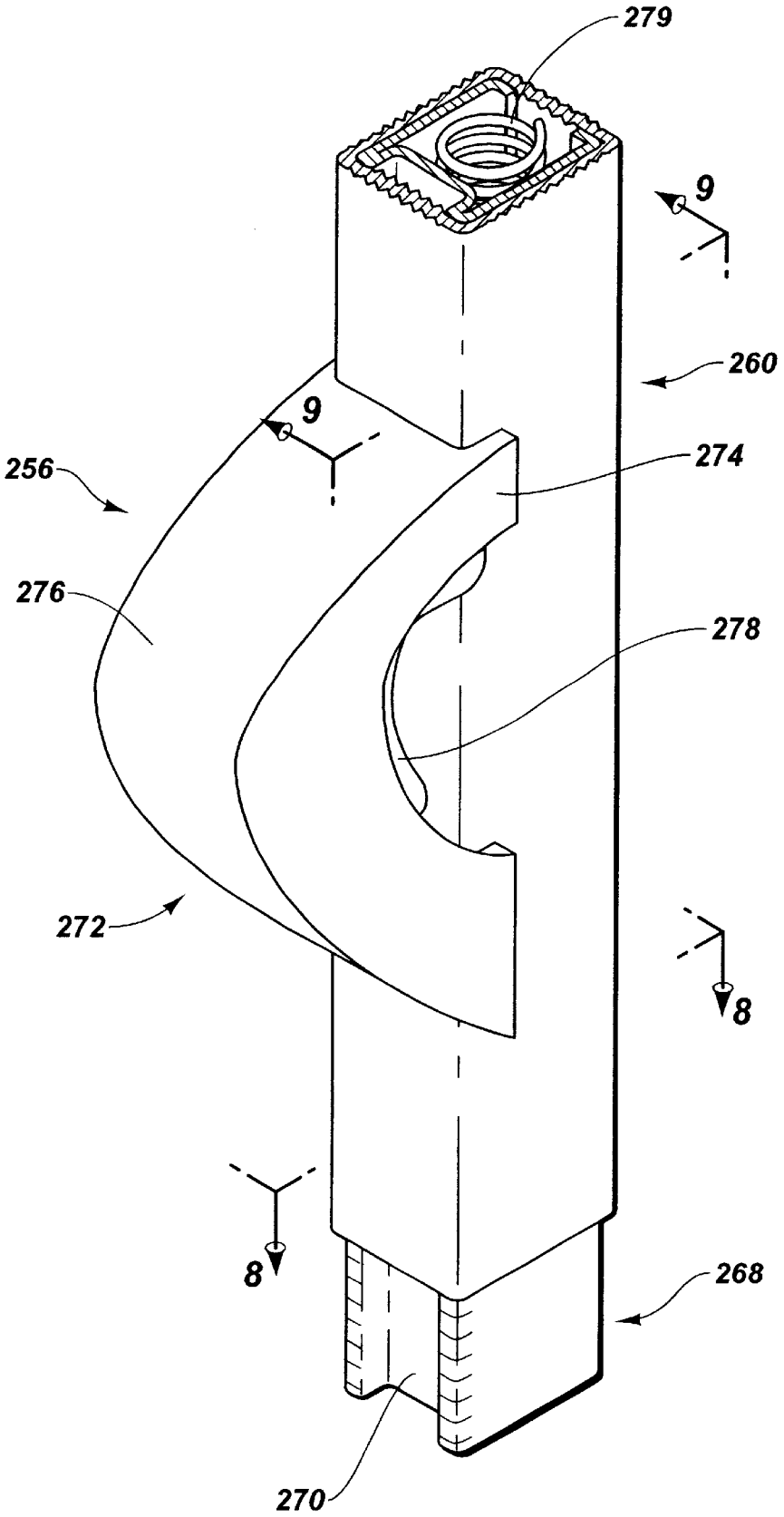
FIG. 7 is a perspective view of another alternative embodiment of a quick-release locking mechanism suitable for an adjustable basketball goal assembly similar to that of FIG. 1.

Referring to FIG. 7, yet another embodiment of an adjustment mechanism 256 for adjusting the height of a basketball goal system 10 is illustrated. Like the adjustment mechanism 156 from the previous embodiment, the adjustment mechanism 256 maybe utilized to rapidly disengage a first arm 260 from a second arm 268 so that the first and second arms 260, 268 can slide with respect to each other and permit adjustment of the height of the basketball goal 18.

As shown in FIG. 7, the second arm 268 may be nested within the first arm 260. If desired, the first arm 260 and second arm 268 may instead be situated next to each other and slidably engaged by, for example, a bracket. Thus, the first arm 260 and second arm 268 may be slidably engaged in a number of different configurations, as will be understood by those skilled in the art. The first and second arms 260, 268 may be connected to the deformable goal structure 14 and the rigid support 12 in much the same fashion as the first and second arms 60, 68 depicted in FIG. 1.

The second arm 268 may have a plurality of openings 270, which may be configured as slots, along the length of the second arm 268. The slots 270 may be separated from each other by a consistent interval, or by an interval that changes along the length of the second arm 268 to ensure that the interval consistently corresponds to a uniform change in height of the basketball goal 18 between each pair of adjacent slots 270. As will be discussed in greater detail below, a portion of the adjustment mechanism 256 engages at least one of the slots 270 to fix the height of the basketball goal 18.

As explained previously, the first arm 260 may be short enough to leave some of the slots 270 exposed. In the alternative, the first arm 260 may be made long enough to cover all the slots in every relative position of the first and second arms 260,268 to reduce the danger of pinching a user's fingers or hands.

An engagement grip 272 may have a housing 274, a handle 276, a release member 278, and other parts which will be discussed in connection with subsequent figures. The engagement grip 272 is an apparatus that engages (fixes the relative positive of) and disengages (allows changing of the relative position of) the first and second arms 260, 268.

The housing 274 may serve a number of purposes, such as protecting the inner workings of the engagement grip 272 by restricting user access thereto. The housing 274 also protects the user from pinching his or her fingers or hands within the engagement grip 272. In addition, the housing 274 may provide structural support to many of the elements within the engagement grip 272, and may provide structure to secure the engagement grip to 272 to the first arm 260. The engagement grip 272 may be secured to the first arm 260 by any known attachment mechanism (e.g., screws, bolts, nuts, rivets, pins, clips, clamps, adhesives, or the like). The housing 274 may be hollow and be formed from a number of different materials, as described in connection with a housing 174 in an alternative embodiment.

Employing the handle 276 and a release member 278, a user may grasp and move the engagement grip 272 to alter the height of the basketball goal 18. The handle 276 is not necessarily shaped to be grasped by a human hand. For example, in one embodiment, the handle 276 may be configured to interface with a prong, or other interface device, on the end of a pole.

The release member 278, in one embodiment, may be at least partially situated within the housing 274. When a user pulls the release member 278 towards the handle, the engagement grip 272 is disengaged, allowing for adjustment of the basketball goal system 10 to a different height. Again, the release member 278 may be positioned in close proximity to the handle 276 so that a user may grasp the handle 276 and release member 278 simultaneously, enabling one-handed adjustment of the basketball goal system 10. The operation of the release member 278 will be discussed in greater detail below.

In one embodiment, the adjustment mechanism 256 may further comprise a counterbalance member 279 to provide a resistant force to at least partially balance a weight of the goal support structure 14. Gravity exerts a force on the goal support structure 14. As a consequence, elevating the goal support structure 14 by moving the engagement grip 272 may require a considerable amount of force. To counteract or diminish the resistance caused by gravity, the adjustment mechanism to 256 may include a counterbalance member 279 that provides a counterbalancing force.

In one embodiment, the counterbalance member 279 may be disposed parallel to the first arm 260 and the second arm 268. In one embodiment, the counterbalance member 279 may comprise one of many different varieties of springs such as a linear spring, leaf spring, gas spring, or torsional spring). The counterbalance member 279 may be coupled at one end to the first arm 260 and coupled to the second arm 268 at the other end. In another embodiment, the counterbalance member 279 may be affixed at one end to the rigid support 12 and that the other end to the goal support structure 14. Those skilled in the art will understand that the counterbalance member 279 may be attached to any one of a number of different locations or elements within the basketball goal system 10 in order to pull the first and second arms 260, 268 towards each other.

Figure 8:
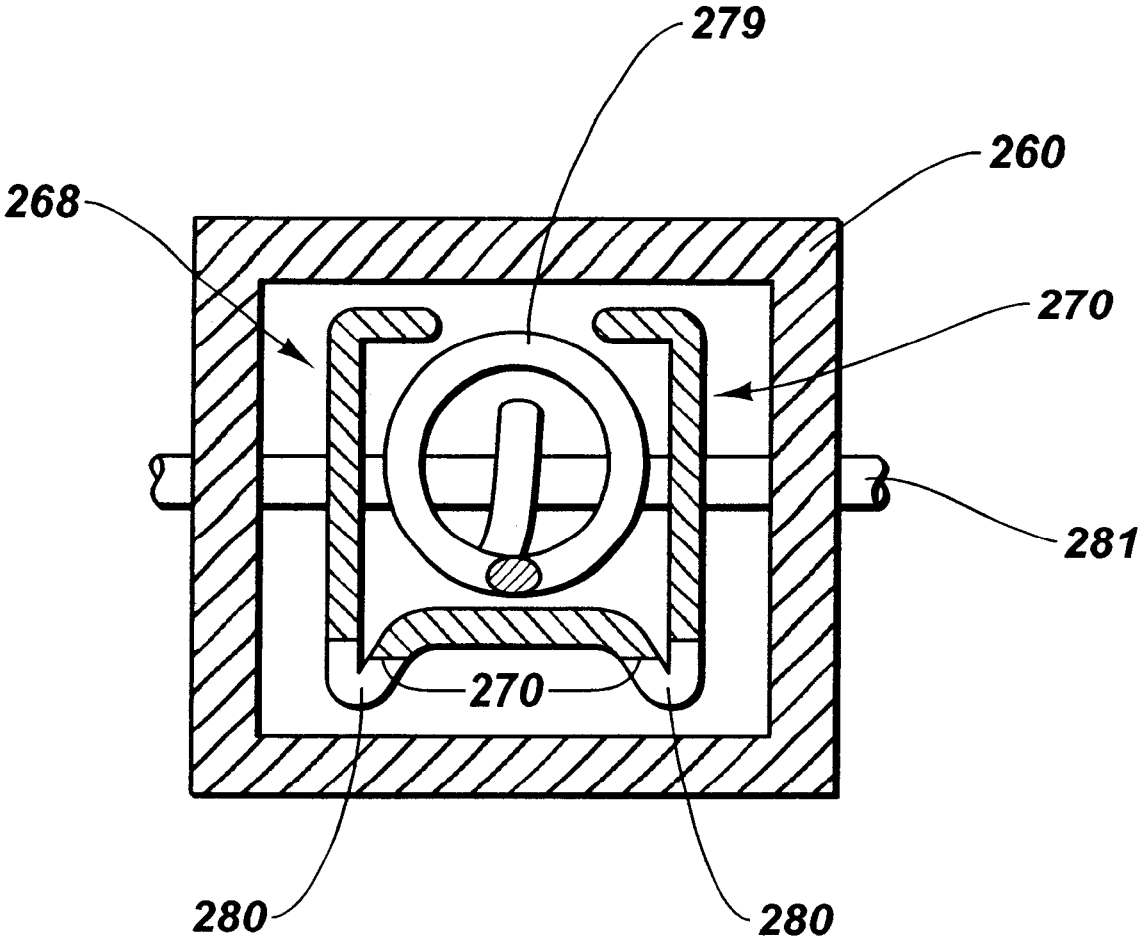
FIG. 8 is a top elevation, section view depicting a cross section of the first and second arms of FIG. 7, with a counterbalance member nested within the arms.

Referring to FIG. 8, a cross-sectional view of the second arm 268 is shown, situated within the first arm 260. Again, in this configuration the first and second arms 260, 268 may be slidably engaged. The second arm 268 may further have a pair of extensions 280. In one embodiment, the openings 270 are formed in the extensions 280. FIG. 8 also illustrates the counterbalance member 279 and a fixing mechanism 281 that may be used to secure one of end of the counterbalance 279 to the first arm 260, the goal support structure 14, or a connector disposed between the first arm 260 and the goal support structure 14.

Figure 9:
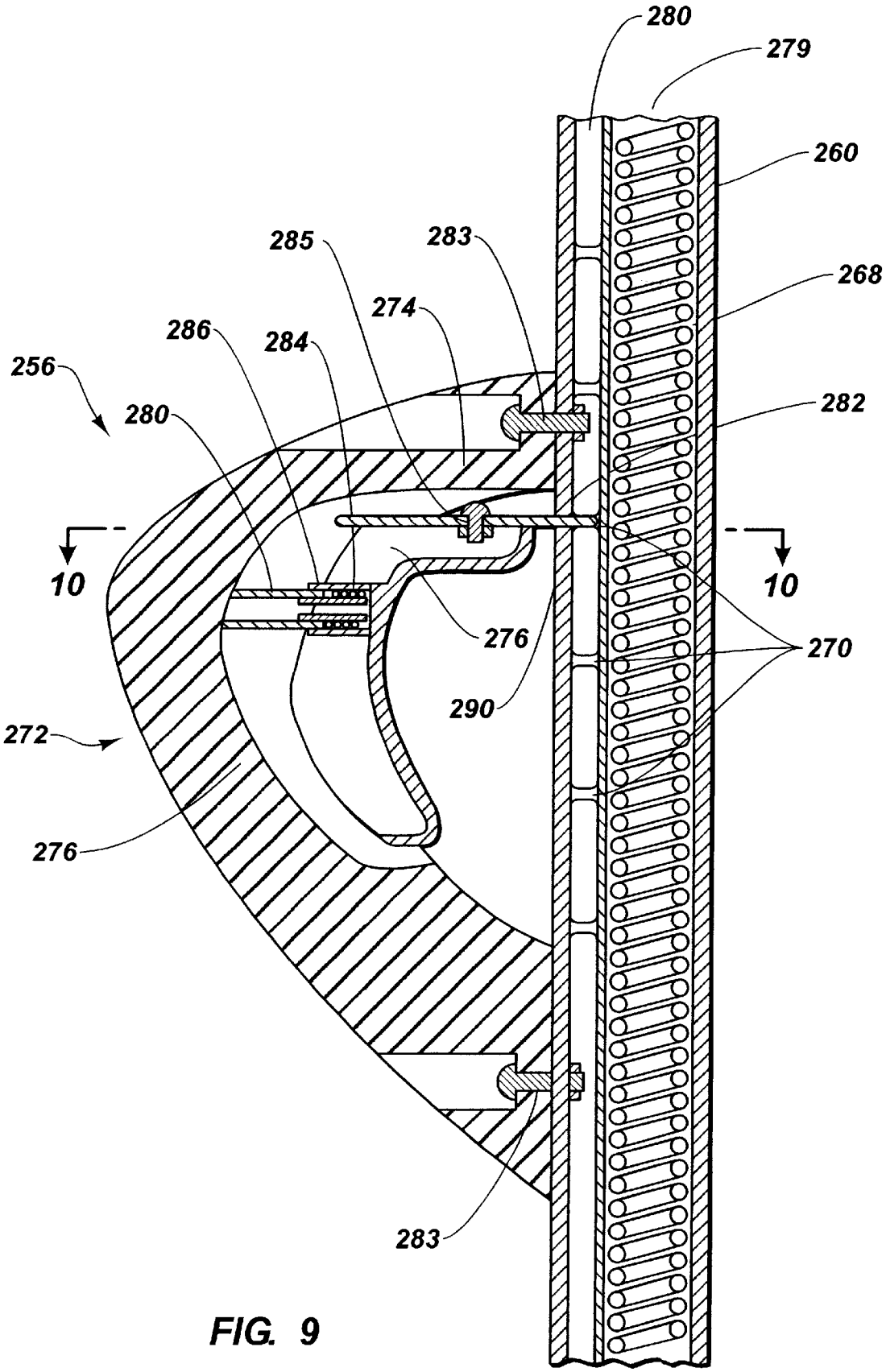
FIG. 9 is a side elevation, section view of the engagement grip, the first arm, the second arm, and the counterbalance member of FIG. 7, showing internal components of the engagement grip.

FIG. 9 illustrates a side elevation, cross-sectional view of the adjustment mechanism 256. This cross-sectional view illustrates the slots 270 in greater detail; the slots 270 may be arrayed along the second arm 268 at periodic intervals. FIG. 9 also illustrates a different cross-sectional view of the second arm 268 disposed within the first arm 260. As shown in FIG. 9, the housing 274 may be attached to the first arm 260 through the use of fasteners 283, each of which may include a bolt and a nut configured to mate with the nut. Alternatively, other attachment mechanisms, such as those described previously, may be used.

FIG. 9 further illustrates one manner in which the engagement grip 272 may engage the second arm 286. A locking member 282, such as a locking plate 282, may engage one of the slots 270 in the second arm 268. The locking member 282 may form a part of the engagement grip 272. Again, the locking member 282 may take the form of a pin, wedge, plate, or any other shape that can be at least partially inserted into an opening 270. A locking plate 282, as shown, may be used to interface with the slots 270.

The locking plate 282 may be formed, for example, from any number of polymers or metals. The locking plate 282, in one embodiment, maybe rigidly attached to a release member 278, such as a trigger. Numerous known attachment mechanisms may be used to attach the locking plate 282 to the release member 278. For example, a nut and bolt system 285 as depicted in FIG. 9, a screw, rivet, clip, clamp, adhesive, or the like may provide the necessary attachment. In one implementation, manufacturing techniques may be employed such that the release member 278 and locking plate 282 form a unitary piece.

The release member 278 may be biased into the engaged position by a biasing member 284. The biasing member 284 may comprise any number of different mechanisms, such as a linear, gas, or torsional springs. En one embodiment, a linear spring 284 is situated within an annular cavity 286 of the release member 278 to maintain the linear spring 284 in the correct position. The linear spring 284 may contact an annular extension piece 288 extending from the housing 274. The force exerted by the linear spring 284 may bias the release member 278 toward the second arm 268. Consequently, in an engaged position, the locking plate 282 may be biased through an aperture 290 in the first arm 260 into one of the openings 270 within the second arm 268. In the engaged position, the height of the basketball goal system 10 may be maintained at a desired level.

When a user grasps the release member 278 and pulls it towards the handle 276, the locking plate 282 may disengage from the second arm 268, enabling a user, with a single hand, to move the basketball goal 18 to a different height and engage the locking plate 282 into a different opening 270. In one embodiment, the housing 274 permits only linear motion of the release member toward and away from the first arm 260.

Figure 10:
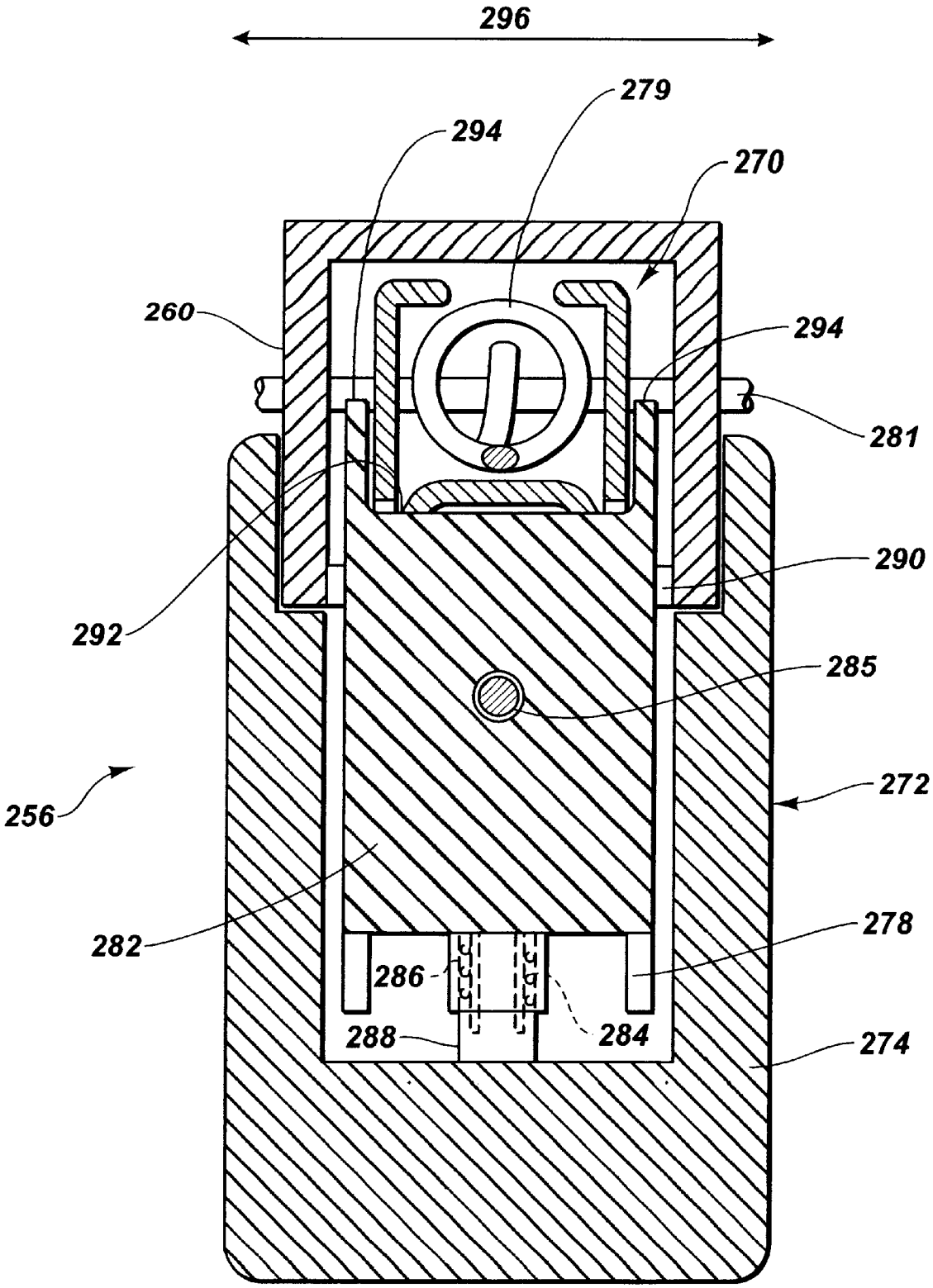
FIG. 10 is a top elevation, section view of the engagement grip, the first arm, the second arm, and the counterbalance member of FIG. 7, depicting interaction of the locking member with an opening of the second arm.

FIG. 10 is a cross-sectional view of the adjustment mechanism 256 in an engaged position. The locking plate 282 may have a forward edge 292 and two prongs 294. In one embodiment, in the engaged position, the forward edge 292 interfaces with an opening 270. The prongs to 294 are situated on opposite sides of the second arm 268 to restrict lateral 296 motion of the locking plate 282 in the engaged position. The openings 270 may also be arrayed such that the forward edge 292 interfaces with two or more openings 270 simultaneously, as depicted in FIG. 10.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An adjustable basketball goal system allowing for adjustment of a height of a basketball goal above a playing surface, the adjustable basketball goal system comprising:

a rigid support;

a deformable goal support structure coupled to the rigid support, the deformable goal support structure being deformable into a plurality of configurations wherein at each configuration a basketball goal is disposed at one of a plurality of heights above the playing surface;

a first arm comprising a first end coupled to the deformable goal support structure;

a second arm having a first end coupled to the rigid support and a second end in slidable engagement with the first arm, the second arm comprising a plurality of openings; an engagement grip attached to the first arm;

one or more locking members at least partially disposed within the engagement grip, the one or more locking members being movable between an engaged position and a disengaged position, wherein if in the engaged position, the one or more locking members engage at least one of the plurality of openings to lock the deformable goal support structure in a selected configuration of the plurality of configurations and if in the disengaged position, the one or more locking members disengage the at least one of the plurality of openings to permit the deformable goal support structure to be deformed from one configuration to another of the plurality of configurations; and an actuator at least partially disposed within the engagement grip, the actuator being sized and configured to move the one or more locking members between the first and second positions.

2. The adjustable basketball goal system of claim 1, wherein the deformable goal support structure comprises a parallelogrammic configuration.

3. The adjustable basketball goal assembly of claim 1, wherein the first arm further comprises a sleeve configured to cover the plurality of openings in each of the plurality of configurations.

4. The adjustable basketball goal system of claim 1, further comprising a biasing member that biases the one or more locking members into the engaged position.

5. The adjustable basketball goal assembly of claim 1, wherein the plurality of openings in the second arm include pairs of openings that are generally aligned perpendicular to a longitudinal axis of the second arm.

6. The adjustable basketball goal assembly of claim 1, wherein the engagement grip includes a housing configured to restrict user access to the one or more locking members, the housing having a handle configured to be gripped by a user.

7. The adjustable basketball goal assembly of claim 1, wherein the one or more locking members consist of one or more locking plates and each of the locking plates have a forward edge for inserting into at least one of the plurality of openings.

8. The adjustable basketball goal assembly of claim 7, wherein each of the one or more locking plates include two prongs disposed on either side of the forward edge to restrict lateral motion of the locking plates in the engaged position.

9. The adjustable basketball goal assembly of claim 7, further comprising a biasing member that is sized and configured to push the one or more locking plates into at least one of the plurality of openings.

10. The adjustable basketball goal assembly of claim 9, wherein the biasing member comprises a linear spring, and wherein the release member comprises an annular cavity configured to contain the linear spring.

11. The adjustable basketball goal assembly of claim 1, wherein the second arm includes at least two extensions and the plurality of openings are disposed in the extensions.

12. The adjustable basketball goal assembly of claim 11, wherein the plurality of openings disposed in the extensions are sized and configured to receive the one or more locking members.

13. An adjustable basketball goal system allowing for adjustment of a height of a basketball goal above a playing surface, the adjustable basketball goal system comprising:

a rigid support;

a deformable goal support structure coupled to the rigid support, the deformable goal support structure being deformable into a plurality of configurations wherein at each configuration a basketball goal is disposed at one of a plurality of heights above the playing surface;

a first arm comprising a first end coupled to the deformable goal support structure;

a second arm having a first end coupled to the rigid support and a second end in slidable engagement with the first arm, the second arm comprising a plurality of openings; and an engagement grip attached to the first arm, a first set of one or more locking members and a second set of one or more locking members at least partially disposed within the engagement grip, the first and second sets of locking members being movable between an engaged position and a disengaged position, wherein if in the engaged position, the first and second sets of locking members engage at least one of the plurality of openings to lock the deformable goal support structure in a selected configuration of the plurality of configurations and if in the disengaged position, the first and second sets of locking members disengage the openings permitting the deformable goal support structure to be deformed from one configuration to another of the plurality of configurations.

14. The adjustable basketball goal assembly of claim 13, further comprising a sleeve configured to cover the plurality of openings in each of the plurality of configurations.

15. The adjustable basketball goal assembly of claim 13, further comprising a release member coupled to the first and second sets of locking members such that user actuation of the release member disengages the first and second sets of locking members from the engaged position.

16. The adjustable basketball goal system of claim 13, further comprising a biasing member connected to the first and second sets of locking members to bias the first and second sets of locking members into the engaged position.

17. The adjustable basketball goal system of claim 13, wherein the first and second sets of locking members are configured to be inserted substantially simultaneously into a pair of openings positioned on opposite sides of the second arm.

18. The adjustable basketball goal assembly of claim 17, wherein the first and second sets of locking members each further comprise an engagement end, the biasing member configured to urge the engagement ends into the of openings.

19. The adjustable basketball goal assembly of claim 13, further comprising a pivot; and wherein the first and second sets of locking members are configured to rotate about the pivot.

20. The adjustable basketball goal assembly of claim 13, wherein the engagement grip includes a housing to restrict user access to the first and second sets of locking members, the housing having a handle configured to be gripped by a user.

21. The adjustable basketball goal assembly of claims 20, wherein the handle is substantially horizontally disposed.

22. The adjustable basketball goal assembly of claim 13, further comprising a counterbalance member disposed parallel to the first arm and the second arm to provide a resistant force to at least partially balance a weight of the deformable goal support structure.

23. An apparatus for adjusting the height of a basketball goal, the apparatus comprising:

a support pole;

an adjustable basketball goal support structure connected to the support pole, the adjustable basketball goal support structure including a first support member and a second support member;

an adjustment mechanism including a first arm connected to the adjustable basketball goal structure and a second arm connected to the support pole, the first arm and second arm being slidably connected;

one or more locking members at least partially disposed within an opening in the first arm, the one or more locking members being sized and configured to contact the second arm, the locking members being movable between a first position in which the first arm and the second arm can move relative to each other and a second position in which the first arm and the second arm are held in a relatively fixed position; and an adjustment handle connected to the first arm in a fixed position and the one or more locking members being at least partially disposed within the adjustment handle.

24. The apparatus of claim 23, further comprising a release member generally disposed within the adjustment handle, the release member being connected to the one or more locking members and being capable of moving the one or more locking members between the first and second positions.

25. The apparatus of claim 23, further comprising a biasing member that biases the one or more locking members into the second position.

26. The apparatus of claim 23, wherein the one or more locking members consist of one or more locking plates.

27. The apparatus of claim 23, wherein the one or more locking members comprise a first set of one or more locking members and a second set of one or more locking members.

28. The apparatus of claim 27, wherein the first set of locking members and the second set of locking members being sized and configured to engage the second arm at different angles.

29. The apparatus of claim 27, wherein the first set of locking members and the second set of locking members are capable of frictionally engaging the second arm to hold the first arm and second arm in a relatively fixed position.

30. The apparatus of claim 27, further comprising a plurality of openings in the second arm.

31. The apparatus of claim 30, wherein the first set of locking members and the second set of locking members are sized and configured to engage one or more of the plurality of openings in the second arm.

32. The apparatus of claim 30, wherein the plurality of openings includes pairs of openings that are generally aligned perpendicular to a longitudinal length of the second&arm; and wherein the first set of locking members are sized and configured to engage a first opening of the pair of openings and the second set of locking members are sized and configured to engage a second opening of the pair of openings.

33. The apparatus of claim 23, further comprising a plurality of openings in the second arm, the one or more locking members being sized and configured to engage an opening of the plurality of openings to hold the first arm and second arm in a relatively fixed position.

34. The apparatus of claim 23, further comprising a plurality of openings in the second arm, the plurality of openings including pairs of openings that are generally aligned perpendicular to a longitudinal length of the second arm, the one or more locking members being sized and configured to simultaneously engage a pair of the openings.

35. The apparatus of claim 23, further comprising a plurality of openings in the second arm, the one or more locking members being sized and configured to engage one or more of the plurality of openings in the second arm.

36. The apparatus of claim 23, wherein the one or more locking members frictionally engage the second arm in the second position.

37. The apparatus of claim 23, wherein the adjustment handle allows the user to simultaneously control the movement of the one or more locking members between the first position and the second position, and to adjust the height of the basketball goal.

38. An apparatus for adjusting the height of a basketball goal, the apparatus comprising:

a support pole;

an adjustable basketball goal support structure connected to the support pole, the adjustable basketball goal support structure including a first support member and a second support member;

an adjustment mechanism including a first arm connected to the adjustable basketball goal structure and a second arm connected to the support pole, the first arm and second arm being slidably connected;

an adjustment member connected to the first arm;

a release member generally disposed within the adjustment member; and one or more locking members connected to the release member and at least partially disposed within the adjustment member, the one or more locking members being movable between a first position in which the first arm and the second arm can move relative to each other and a second position in which the first arm and the second arm are held in a relatively fixed position.

39. The apparatus of claim 38, wherein the release member is capable of selectively moving the locking members between the first and second positions.

40. The apparatus of claim 38, further comprising a biasing member that biases the one or more locking members into the second position.

41. The apparatus of claim 38, wherein the one or more locking members consist of one or more locking plates.

42. The apparatus of claim 38, wherein the one or more locking members comprise a first set of one or more locking members and a second set of one or more locking members, the first set of locking members and the second set of locking members being sized and configured to engage the second arm at different angles.

43. The apparatus of claim 38, further comprising a plurality of openings in the second arm, the one or more locking members being sized and configured to extend into the plurality of openings in the second arm.

44. The apparatus of claim 38, wherein the one or more locking members frictionally engage the second arm.

45. The apparatus of claim 38, wherein the adjustment handle allows the user to use a single hand to control the movement of the one or more locking members between the first position and the second position, and to adjust the height of the basketball goal.

46. A method for adjusting the height of a basketball goal, the method comprising:

providing a support pole;

providing an adjustable basketball goal support structure connected to the support pole, the adjustable basketball goal support structure including a first support member and a second support member;

providing an adjustment mechanism including a first arm connected to the adjustable basketball goal structure and a second arm connected to the support pole, the first arm and second arm being slidably connected;

providing one or more locking members at least partially disposed within an opening in the first arm, the one or more locking members being sized and configured to contact the second arm, the locking members being movable between a first position in which the first arm and the second arm can move relative to each other and a second position in which the first arm and the second arm are held in a relatively fixed position; and providing an adjustment handle connected to the first arm, the adjustment handle capable of selectively moving the locking members between the first and second positions.

47. A method for adjusting the height of a basketball goal, the method comprising:

providing a support pole;

providing an adjustable basketball goal support structure connected to the support pole, the adjustable basketball goal support structure including a first support member and a second support member;

providing an adjustment mechanism including a first arm connected to the adjustable basketball goal structure and a second arm connected to the support pole, the first arm and second arm being slidably connected;

providing an adjustment member connected to the first arm;

providing a release member generally disposed within the adjustment member; and providing one or more locking members connected to the release member and at least partially disposed within the adjustment member, the one or more locking members being movable between a first position in which the first arm and the second arm can move relative to each other and a second position in which the first arm and the second arm are held in a relatively fixed position.

* * * * *

UNITED STATES PATENT AND TRADEMARK OFFICE

CERTIFICATE OF CORRECTION

PATENT NO. : 6,488,599 B2 
DATED : December 3, 2002
INVENTOR(S) : S. Curtis Nye

It is certified that error appears in the above-identified patent and that said Letters Patent is hereby corrected as shown below:

Column 1,
Line 25, after "sport" change "In" to -- in --

Column 10,
Line 24, after "secured" change "," to -- . --

Column 13,
Line 3, before "grip" insert -- engagement --
Line 3, after "grip 172" insert -- , --

Column 15,
Line 39, after "spring" delete ")"

Column 16,
Line 5, after "second arm" change "286" to -- 268 --
Line 27, before "one embodiment" change "En" to -- In --

Column 19,
Line 67, before "and wherein" change "second&arm;" to -- second arm; --

Signed and Sealed this

Thirteenth Day of May, 2003

JAMES E. ROGAN
*Director of the United States Patent and Trademark Office*